United States Patent [19]

Quenzi

[11] Patent Number: 4,505,632

[45] Date of Patent: Mar. 19, 1985

[54] COMPACT LOADER-TRAMMER

[75] Inventor: Phil Quenzi, Atlantic Mine, Mich.

[73] Assignee: Northern Industrial Sales & Service, Inc., Painesdale, Mich.

[21] Appl. No.: 630,344

[22] Filed: Jul. 13, 1984

Related U.S. Application Data

[63] Continuation of Ser. No. 433,502, Oct. 8, 1982, abandoned.

[51] Int. Cl.[3] ..... B60P 1/00

[52] U.S. Cl. ..... 414/510; 414/514; 414/517; 414/549; 414/551; 414/554; 414/685; 414/749

[58] Field of Search ..... 414/549, 551, 554, 509, 414/510, 517, 541, 685, 749

[56] References Cited

U.S. PATENT DOCUMENTS

| | | | |
|---|---|---|---|
| 2,712,876 | 7/1955 | Kuehn, Jr. | 414/551 |
| 3,012,813 | 12/1961 | Reese | 414/549 X |
| 3,306,478 | 2/1967 | Moehr | 414/551 X |
| 4,067,466 | 1/1978 | Parks et al. | 414/519 X |

OTHER PUBLICATIONS

Northern Industrial Sales and Service, "Ranger"-Data Sheets Models OH-130, OH-100, OH-250 & OH-350 (14 pages, undated).

Goodman, Conway Mucker (3 pages, undated).

Atlas Copco, Guide Book of Underground Mining Equipment, 1980/1981, p. 1, pp. 32-50.

*Primary Examiner*—Joseph E. Valenza

*Assistant Examiner*—Stuart J. Millman

*Attorney, Agent, or Firm*—Trexler, Bushnell & Wolters, Ltd.

[57] ABSTRACT

Material handling apparatus comprises a mobile frame defining a longitudinal axis and a raised load compartment on the mobile frame substantially in alignment with said longitudinal axis, and having open front and rear ends. A material handling bucket is pivotally mounted to a carriage mounted for longitudinal movement in an axial direction. A drive is provided driving the carriage bidirectionally in the axial direction. A cam surface is defined substantially continuous with the open front end of the raised load receiving compartment and continuing to a location vertically therebelow. The bucket is arranged for simultaneously pivoting and riding along the cam surface and the load compartment in response to the movement of the carriage for alternatively loading material through the open front end of the load receiving compartment and clearing the load receiving compartment of material loaded thereupon through the open rear end thereof.

20 Claims, 8 Drawing Figures

COMPACT LOADER-TRAMMER

This application is a continuation, of application Ser. No. 433,502, filed Oct. 8, 1982, now abandoned.

BACKGROUND OF THE INVENTION

This invention is directed generally to material handling apparatus and more particularly to a novel, compact loader-trammer vehicle.

While the present invention may find utility in a variety of applications, the invention is particularly useful in mining operations. In this regard, the invention provides a marked improvement over existing equipment for scraper or slusher operations in small stope mines.

It will be appreciated that working space is quite limited in underground mining operations. Generally speaking, a stope mine is an underground mine in which the veins of material to be removed run generally in a vertical or angular, generally vertically oriented direction. Hence, such mines generally make use of plural horizontal shafts or "drifts" vertically aligned one above the other for mining out the vertical or angularly oriented veins of ore. An upper one or ones of the horizontal drifts is the working or mining drift while a lower drift receives railcars or other suitable vehicles and is generally termed the "rail drift". Generally speaking an elongate vertical bore or shaft is provided between the working drift and the rail drift and material mined from the working drift is carried to this vertical shaft to be delivered therethrough to the waiting railcars therebelow.

It will also be appreciated that a similar situation applies in a "room and column" mining configuration which generally comprises a main vertical shaft with a plurality of horizontal drifts converging at different levels thereof. Hence, material must be delivered to waiting elevators at the main vertical shaft.

In either of the foregoing mining situations, as with any underground mine, working space is generally limited. The prior art has generally proposed utilizing conventional front loader or similar vehicles and separate haulage trucks to accomplish movement of the mine material in the horizontal drifts. However, it will be appreciated that this arrangement requires room for maneuvering of both haulage trucks and front loaders within the drift. In many situations this may be difficult or impossible.

Advantageously, the present invention provides a compact and efficient combination loader-trammer vehicle which advantageously loads, trams the load and discharges the load without requiring turning around in the drift. Moreover, it will be appreciated that the use of but a single vehicle to both load, haul and unload the material is particularly advantageous.

OBJECTS AND SUMMARY OF THE INVENTION

It is therefore a general object of this invention to provide a novel and improved compact loader-trammer vehicle.

A more specific object of the invention is to provide a compact loader-trammer vehicle which is capable of loading, transporting and unloading material without requiring turning around of the vehicle.

A related object is to provide a compact loader-trammer vehicle in accordance with the foregoing objects which is relatively simple and inexpensive in its design and manufacture and yet highly reliable in operation.

Briefly, and in accordance with the foregoing objects, a material handling apparatus in accordance with this invention comprises a mobile frame defining a longitudinal axis and an open-ended, raised load compartment on said mobile frame substantially in alignment with said longitudinal axis. A material handling bucket is provided and a carriage mounted for longitudinal axial movement along the frame carries means pivotally mounting said bucket. Actuating means are also provided for driving the carriage bidirectionally in the axial direction. A cam surface is defined substantially continuous with a first open end of the load compartment and running to a location vertically therebelow. Cooperating means on said bucket simultaneously slides and pivots the bucket with respect to said cam surface in response to the movement of the carriage for alternatively loading material from the bucket through the first open end of the load compartment or clearing the load compartment of material loaded thereupon through the second open end thereof as the bucket is moved both axially and pivotally by the carriage.

BRIEF DESCRIPTION OF THE DRAWINGS

The foregoing, as well as other objects, features and advantages of the invention will be more readily appreciated upon consideration of the following detailed description of the illustrated embodiment, together with reference to the drawings, wherein.

DETAILED DESCRIPTION OF THE ILLUSTRATED EMBODIMENT

Figure 1:
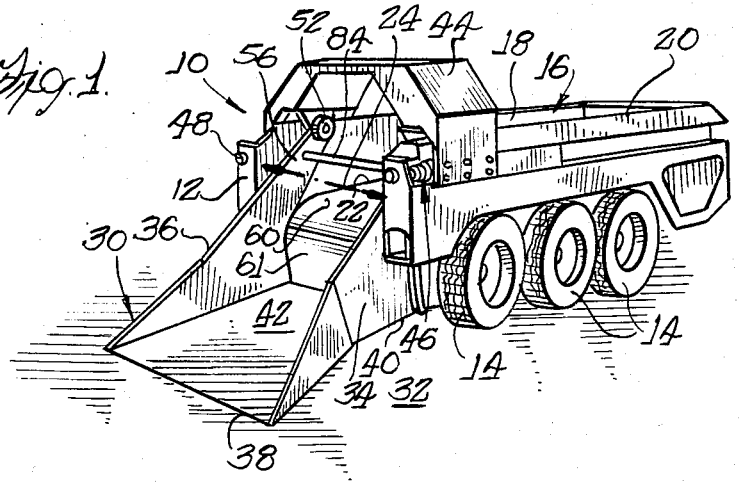
FIG. 1 is a front perspective view of a material handling apparatus in accordance with this invention, including a bucket portion thereof oriented for receiving material from a ground or grade surface.
Figure 2:
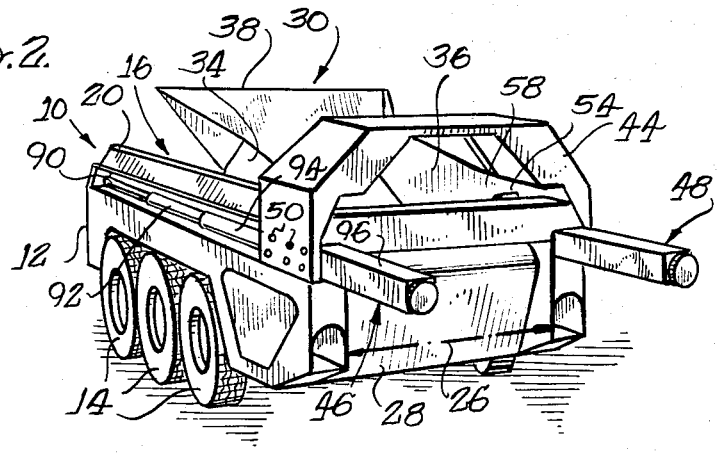
FIG. 2 is a rear perspective view of the apparatus of FIG. 1 and further illustrating the bucket portion thereof in a fully retracted position for moving material into and along a load-receiving compartment thereof.

Referring now to the drawings and initially to FIGS. 1 and 2 there is seen a mobile material handling apparatus in accordance with the invention and designated generally by the reference numeral 10. This apparatus 10 includes a frame 12 which is rendered mobile by mounting on suitable means such as wheels 14. Suitable motive power means may be utilized to rotate the wheels so as to impart mobility to the apparatus 10 as will be seen later.

Figure 4:
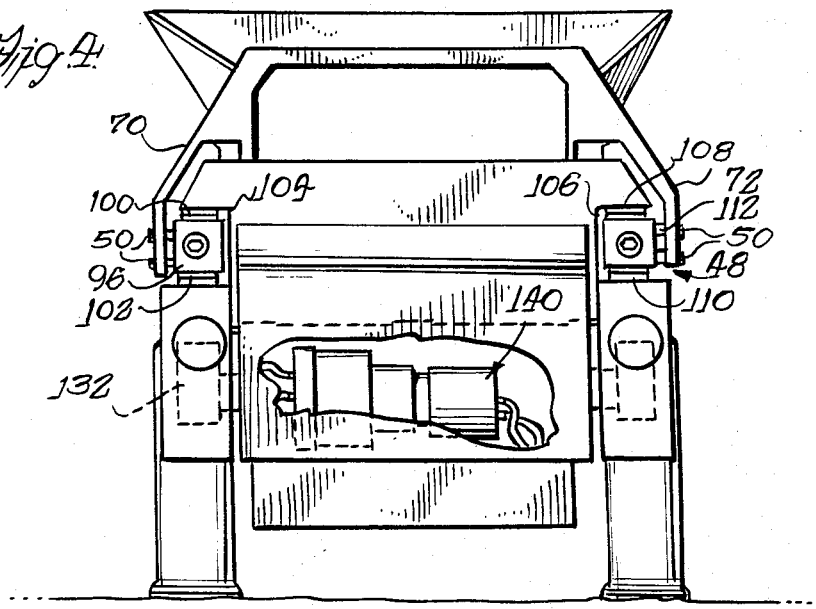
FIG. 4 is a rear elevation of the apparatus of FIG. 3.
Figures 3, 5:
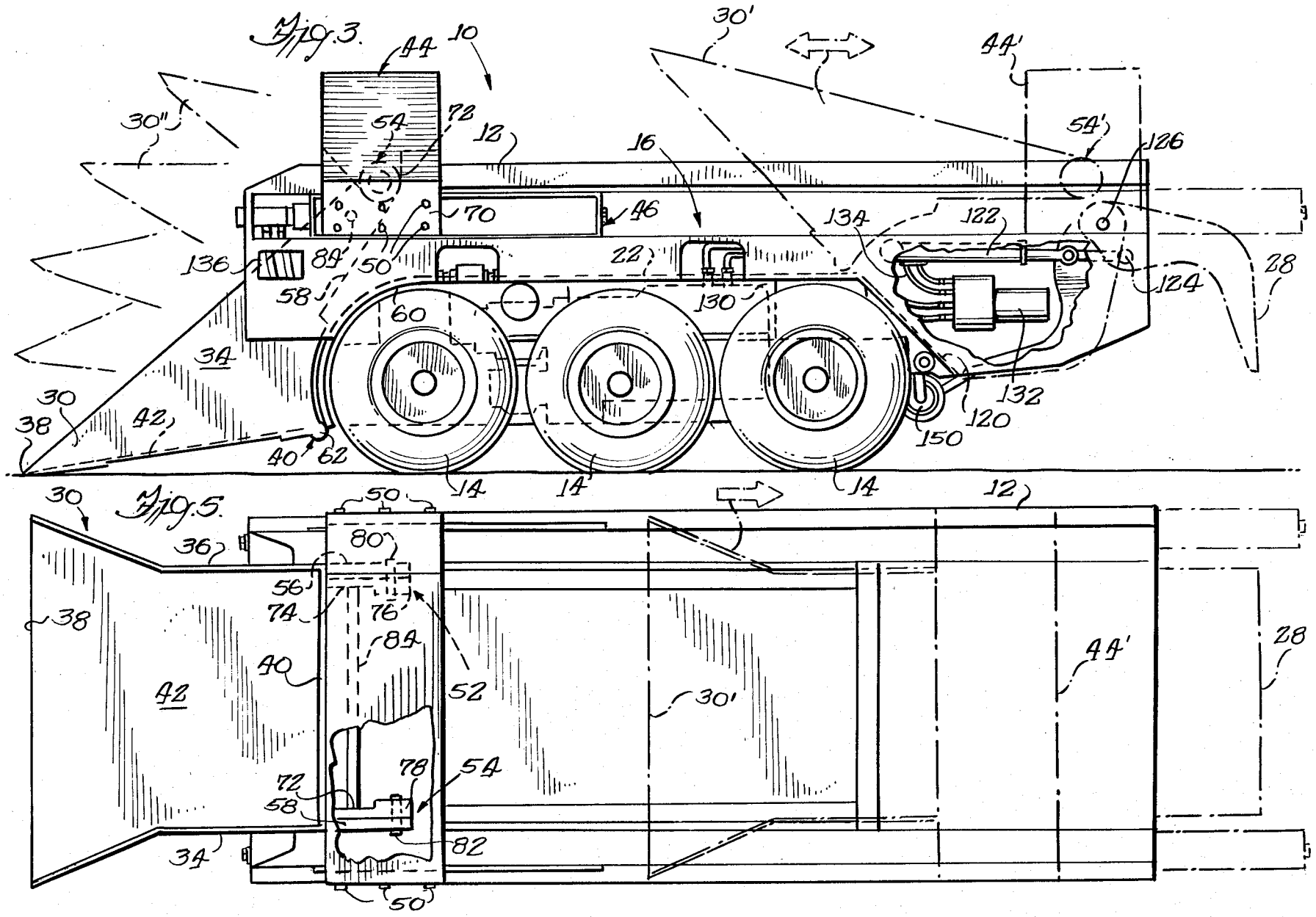
FIG. 3 is a partially broken away side elevation, of the apparatus of FIGS. 1 and 2, and illustrating operation of the material handling apparatus of this invention.
FIG. 5 is a top plan view of the apparatus of FIG. 3.

Referring now also to FIGS. 3, 4 and 5, the frame 12 mounts a load receiving compartment 16. In the illustrated embodiment, this load receiving compartment 16 is defined by respective spaced apart interior side walls 18 and 20 and a substantially flat elongate load deck or floor 22 extending between the side walls 18 and 20. In the illustrated embodiment, this load deck is substantially rectilinear in configuration and of greater length than width, being oriented substantially coaxially with the frame 12. However, other configurations of load compartment may be utilized without departing from the invention.

The load compartment 16 also defines an open front end 24 and an open rear end 26. The open rear end 26 is provided with a movable tailgate 28.

A load receiving bucket member 30 is arranged for delivering material from a ground or grade surface 32 into the load receiving compartment 16 of the apparatus 10. In the illustrated embodiment, this bucket 30 comprises a pair of opposed side walls 34, 36, a front lip portion 38, a rear heel portion 40 and a bucket floor or bottom 42 which extends between the two sides 34, 36 and also between the front lip 38 and rear heel portion 40. Advantageously, the width of the rear heel portion 40 including the portions of side walls 34 and 36 extending therefrom is such as to provide a relatively close, sliding fit between the heel 40 and the load floor 22 and also between respective bucket sides 34 and 36 and the load compartment sides 18 and 20 when the bucket is raised into the load compartment 16 as illustrated in FIG. 2. Hence, the rear heel portion and adjacent portions of side walls 34 and 36 of the bucket act essentially as a scraper for dragging or scraping material along the load floor 22. As will be presently described, this scraping action is advantageous in both loading material into the load compartment 16 and in discharging material from the load compartment 16 through the open rear end 26 when the tailgate 28 is opened.

From the foregoing, it will be appreciated that the respective shapes of the bucket 30 and load compartment 16 described with reference to the preferred embodiment may be modified without departing from the invention. What is important in this regard is the provision of a closely interfitting sliding relationship between at least a portion of the bucket and the load compartment, to achieve the scraping action described above.

It will be further noted that the deck or floor 22 of the load compartment 16 is raised some distance above the ground or grade level 32. Hence, a suitable coupling is provided for moving the bucket from the down or lowered position illustrated in FIG. 1 to the up or raised position illustrated in FIG. 2. In the illustrated embodiment, this coupling and raising and lowering motions are provided by a movable carriage 44 which is mounted for axial longitudinal movement with respect to the frame 12. In the illustrated embodiment, the axial longitudinal movement of the carriage 44 is provided by a pair of telescoping cylinder assemblies designated generally by the reference numerals 46 and 48. The carriage is coupled to the telescoping cylinder assemblies 46 and 48 by suitable means such as bolts 50. Accordingly, as the respective cylinders 46 and 48 are telescopically extended and retracted in unison, the carriage 44 moves in unison therewith in the axial direction, both forwardly and rearwardly along the frame 12.

The bucket 36 is pivotally joined with the carriage 44 at a pair of generally coaxially aligned pivot points 52 and 54. These pivot points are located at respective extensions or arms 56, 58 of the bucket 36.

The load compartment floor or deck 22 extends outwardly and downwardly from the open end 24 of the load compartment to provide a suitable inclined ramp or cam surface extending from the level of the load floor 22 toward the ground surface 32. In the illustrated embodiment, this extension or cam surface is formed by an arcuately downwardly curved extension 60 of the load floor 22 and by a suitably arcuately curved extension plate or member 61 which extends substantially continuously from the edge of the load floor extension 60. Preferably, these two arcuate surfaces 60 and 61 collectively define an arc of at least 90 degrees and preferably somewhat greater.

Cooperatively, the rear heel portion 40 of the bucket 30 is provided with a complimentary cam surface 62 which is preferably substantially cylindrical in configuration for slideably engaging the cam surfaces 60 and 61. As best viewed in FIG. 3, the cam surface 61 extends downwardly to a sufficient extent so as to engage the complimentary cam surface 62 of the bucket heel portion 40 when the bucket is in its lowered position as illustrated in FIG. 1 and in solid line in FIG. 3. In order to move the bucket to the raised position illustrated in FIG. 2 and in phantom line at 30' in FIG. 3, the carriage 44 is drawn axially rearwardly by telescopic extension of the cylinders 46 and 48. This causes a simultaneous pivoting and sliding motion of the bucket 30 with respect to the pivots 52, 54 and the arcuate cam surfaces 60 and 61. It should be appreciated in this regard that the length of the extensions or arms 56 and 58 are such as to permit at least the front or lip portion 38 of the bucket 30 to engage the ground or grade surface 32 when the bucket is in the lowered position.

From the foregoing it will be seen that any suitable ramp or inclined surface at the forward end of the load floor or deck 22 will serve to slideably rotate or pivot the bucket 30 in the fashion illustrated and described herein. However, it is preferred to utilize the arcuate surfaces 60 and 61 as described above, to resist any lifting or pivotal movement of the bucket 30 when it is in the down or lowered position, which might occur due to impingement of a load of material against the leading edge or lip 38. It will be appreciated that since the extension of the arc provided by the surfaces 60 and 61 is at least equal to and preferably greater than 90 degrees, the engagement of the bucket heel or cam surface 62 with the lowermost portion of the plate or cam surface 61 will resist such lifting or pivoting movement of the bucket 30 when in the lowered position. However, it will be apparent that the linear rearward movement of the carriage 44 and the pivotal coupling 52, 54 of the bucket therewith will readily initiate sliding movement between the heel or cam surface 62 and the cam surface 61 readily overcoming the slight resistance in the plane of movement therebetween due to the somewhat greater than 90 degree extent of arc defined by the surfaces 60 and 61. That is, forces tending to lift the bucket due to impingement of material at the lip 38 will act generally in a horizontal direction pushing the bucket back against the cam surface 61, whereas the forces tending to lift the bucket in response to movement of the carriage 44 will act primarily in a vertical direction, thus meeting with little resistance from the cam surface.

In operation, the load compartment 16 may be loaded with material relatively simply and expeditiously by the foregoing structure. Briefly, the bucket 30 is initially held in its lowered position as illustrated in FIG. 1, while the wheels 14 are driven by suitable means to propel the apparatus 10 in the forward direction. Hence, the bucket will impinge upon and collect material along the ground or grade surface 32 as the apparatus 10 moves in the forward direction. When the desired quantity of material is received in the bucket 30, the forward motion may be halted and the telescoping cylinders 46 and 48 energized by suitable means to move the carriage 44 axially rearwardly along the frame 12. As shown in phantom line in FIG. 3, as the bucket is pivotally and slideably moved by this action of the carriage 44, the front or lip portion is inclined to a level above the heel portion 40 thereof. In other words, the bottom or floor 42 of the bucket 30 is inclined so as to retain the material which has been collected therein. When the cam surface 62 and heel 40 of the bucket reaches the upper end of the arcuate extension 60 and the substantially horizontal level of the load floor or deck 22, the bucket will have achieved the fully raised and fully inclined position illustrated at 30'. Thereafter, further motion of the bucket consists of longitudinal sliding motion along the load compartment 16. It will be appreciated that the degree of inclination of the bucket at this point causes the material carried therein to be delivered through the open rear end of the bucket 30 into the load compartment 16. Moreover, upon delivering a first load of material to an empty load compartment 16, the carriage 44 and hence bucket 30 are carried rearwardly to the extent indicated at 30' in FIG. 3 to load the material into the rear most portion of the load compartment 16. Thereafter, successive loads of material may be successively positioned to gradually fill the load compartment 16 from the rear end to the front end thereof by the simple expedient of limiting the rearward movement of the carriage 44 as the compartment 16 is filled.

When the load compartment 16 is filled with the desired amount of material or fully filled, as the case may be, the bucket 30 is raised, but not drawn across the load floor 22, by the procedure already described to either the fully raised position or to some intermediate position. This intermediate position may comprise one of the positions shown in phantom line and indicated generally by reference numeral 30" in FIG. 3, the bucket then acting as a front closure for the otherwise open front end 24 of the load compartment 16. This position may be referred to as the tramming position of the bucket 30, wherein the load may be hauled or trammed, as termed in the art.

Referring now more in detail to FIGS. 1 through 5, inclusive, further details of the embodiment illustrated herein will be described. It will be understood that various modifications may be made in the details of the structures to be described herein without departing from the invention. Rather, the features of the invention and operation described above may be achieved by various equivalent or alternative structures, the invention being defined by the claims appended hereto.

Referring initially to the bucket 30, in the preferred embodiment illustrated, the arms 56, 58 and side walls 34, 36 extend substantially in a straight line to meet the bottom or floor 42 at the front lip or edge 38. Preferably, lower portions of the side walls 34 and 36 are flaired outwardly somewhat to encourage the egress of material into the bucket 30 as the apparatus 10 is propelled in the forward direction. Additionally, it will be seen that rear edges of respective side walls 34 and 36 are arcuately shaped to closely approach, but avoid interference with the arcuate cam surfaces 60 and 61. Moreover, the respective arms 56 and 58 are stepped back somewhat from the arcuate rear edges of the side walls 34 and 36 also to avoid interference with the sliding of the cam or heel surface 62 upon the cam surfaces 60, 61 as described above.

The carriage 44 will be seen to preferably comprise a generally U-shaped yoke member having downwardly extending side walls 70 and 72 which receive suitable coupling means such as bolts 50 therethrough for coupling to the respective cylinder assemblies 46 and 48. The U-shaped carriage or yoke 44 thus extends above and across the load compartment 16. Accordingly, the pivotal connections with the arms or extensions 56 and 58 are accomodated by a pair of downwardly extending ears or tabs 72, 74 of the yoke or carriage 44. These downwardly extending tabs 72 and 74 are further preferably provided with enlarged, disc-like through apertured bearing members 76, 78 which align with similar through apertured end portions of the respective bucket extensions or arms 56 and 58. Suitable pivot pins 80 and 82 are inserted through these aligned through apertures. An additional transverse support rod 84 is also preferably provided across the arms or extensions 56, 58 of the bucket 30.

The telescoping cylinder assemblies 46 and 48 are substantially identical whereby only one such assembly will be described. The cylinder assembly 46 in the illustrated embodiment comprises a telescoping assembly of three cylinder members 90, 92 and 94, as best viewed in FIG. 2. Additionally, the outer most or largest diameter cylinder 94 is provided with a substantially rectilinear housing or casing member 96. It is this housing or casing member 96 which is coupled with the carriage or yoke 44 by respective bolts 50 as described above. Additionally, and as best viewed in FIG. 4, this housing or casing member 96 is substantially rectangular in cross-section and carries respective top and bottom bearing surfaces 100 and 102.

Preferably a pair of similar rectangular axially extending recesses or channels 104 and 106 formed in side walls of the frame 12 to carry the respective cylinder assemblies 46 and 48. In this regard, the recesses or channels 104 and 106 are substantially rectangular in cross-sections and carry complimentary bearing surfaces 108 and 110 for slideably engaging the bearing surfaces 100, 102 of the respective casings or housings 96. From the foregoing it will be seen that the provision of the U-shaped yoke configuration of the carriage 44 cooperates with the foregoing assembly by positioning and holding the respective housings or casings 96 within the recesses or channels 104 and 106 against lateral movement. Accordingly, the yoke 44 assures substantially axial, longitudinal movement only of the respective telescoping assemblies 46 and 48. Moreover, the housings or casings 96 are of substantially greater cross-sectional dimension than the largest of the cylinders 94, whereby the cylinders 90, 92 and 94 are held out of engagement with respective inside surfaces of the recesses or channels 104 and 106. Additionally, suitable spacer members as indicated at 112 may be interposed between the facing surfaces of the side extensions 70, 72, of the yoke member 44 and of the respective casings 60. The spaces 112 are preferably provided with suitable through apertures for receiving the bolts 50 therethrough.

In accordance with a preferred form of the invention, the load floor 22 is preferably downwardly sloped at its rear most portion as indicated by reference numeral 120. This rearward sloping end portion 120 meets the tailgate 26 when the latter is in its fully closed position to close off the otherwise open end 24 of the load compartment 16. Advantageously, the slope of this load floor portion 120 may be defined to form a continuation of the slope defined by the floor or bottom 42 of the bucket 30 when in its fully raised and rear most position as illustrated at 30' of FIG. 3. This downward sloping portion 120 of the load floor or deck 22 aids in discharging material from the load compartment 16 when the tailgate 26 is opened as illustrated in phantom line in FIG. 3. In this regard, a suitable extensible and retractable cylinder member 122 is coupled at one end thereof to the frame 12 and at the opposite end thereof to a suitable pivot point 124 on the tailgate 28. The tailgate 28 is pivoted by the cylinder 122 about a suitable pivot point 126 coupled with the frame 12. The respective cylinders 46 and 48 and tailgate cylinder 122 may be selectively energized by a suitable hydraulic system including suitable hydraulic motors and valves as illustrated generally at 130 and 132. Suitable connecting lines to provide pressurized hydraulic fluid and drain lines are also provided as indicated at 134 with respect to the tailgate cylinder 122 and at 136 at the front most portion of the cylinder assemblies 46, 48. In this regard, front end portions of the respective cylinder assemblies 46 and 48 may be held by suitable means in through apertures provided therefor in a front end of the frame member 12.

Suitable power for rotating the wheels 14 of the apparatus 10 in either the forward or rearward direction may be provided by suitable means, such as electro-hydraulic motors. In this regard, in the illustrated embodiment, as shown in FIG. 4, a suitable electro-hydraulic assembly is indicated generally at 140. A similar assembly, comprising a suitable electrically powered hydraulic motor and gear assemblies is preferably coupled to one each of the three wheels 14 to either side of the apparatus 10, whereupon the remaining wheels are coupled to rotate in unison with the driven wheel. A suitable electric cable connection is provided at 150 as shown at FIG. 3 to receive a suitable electric cable for providing power to the hydraulic drive components just described. Other suitable sources of power such as an on board diesel engine or the like may alternatively be provided.

As mentioned previously, other means and structures may be utilized to accomplish the sliding and pivoting motion of the bucket 30 described above. Two such alternative embodiments are shown respectively in FIG. 6 and FIGS. 7 and 8. The parts and components thereof which are identical to the embodiment described above are designated by like reference numerals, together with the suffix a in the embodiment of FIG. 6 and the suffix b in the embodiments of FIGS. 7 and 8.

Figure 6:
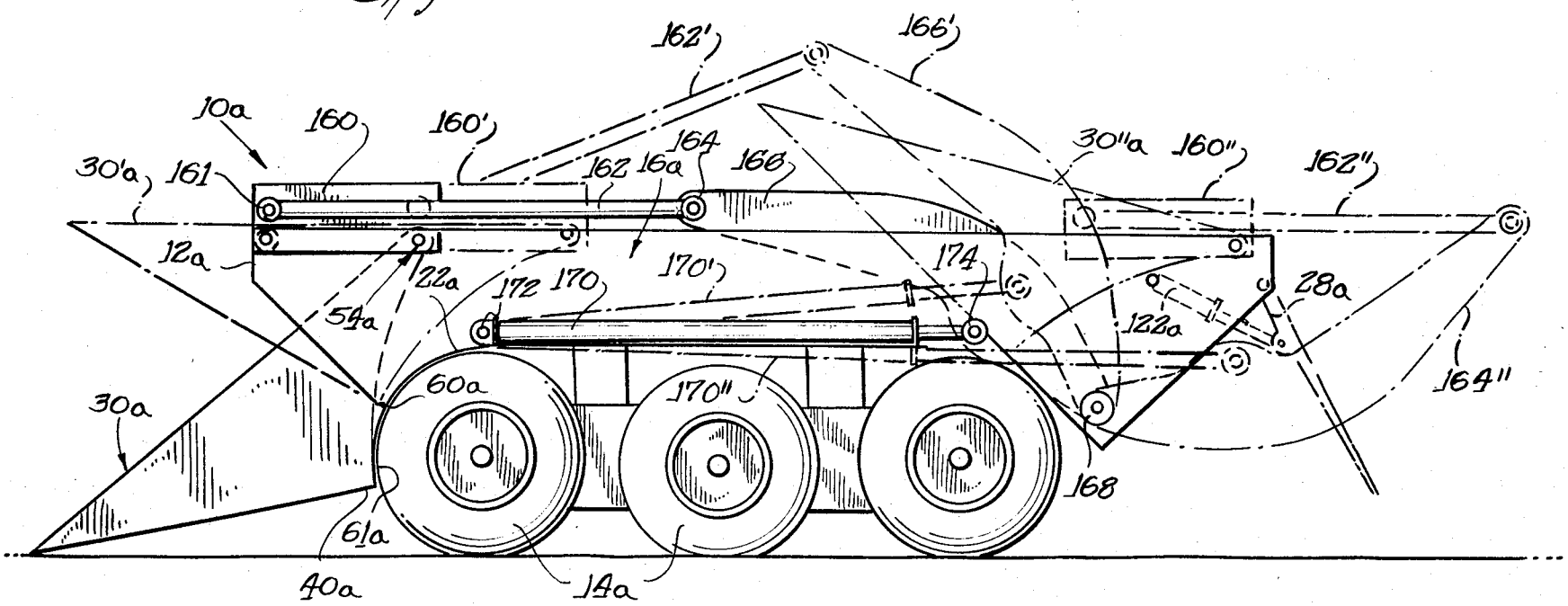
FIG. 6 is a side elevation illustrating an alternative form of apparatus in accordance with the invention.

Referring now to FIG. 6, a material handling apparatus **10*a* includes a mobile frame 12*a* having wheels 14*a* and a load compartment 16*a*** all configured substantially similarly to the like described components hereinabove.

A bucket **30*a* is arranged for pivotal and sliding movement with respect to a load floor 22*a* and arcuate extensions thereof 60*a* and 61*a* in the same fashion as described above. The pivot points 52*a*, 54*a* of the bucket are coupled to an axially slideably movable carriage or yoke member 160 which differs somewhat from the carriage 44** described above.

It will be understood that identical structure to that about to be described herein is also provided to the opposite side of the apparatus **10*a* to that shown in FIG. 6. This carriage 160 carries a first pivot 54*a* at its lower rear end coupled to the bucket 30*a* as previously mentioned. A second pivot 161 is located at the front top portion of the carriage 160 and is pivotally coupled with one end of a first linkage member 162. The opposite end of this first linkage member 162 is pivotally coupled at 164 to one end of a second linkage member 166. The linkage member 166 has its opposite end pivotally coupled at 168 to a side wall of the frame 12*a*. The linkage assembly comprising linkages 162 and 166 is arranged to slideably move the sliding carriage member 160 in response to expansion and contraction of a piston 170. This piston 170 is pivotally mounted at 172 to a side wall of the frame 12. The opposite end of the piston 170 is pivotally mounted at 174 to a central portion of the linkage member 166 which will be seen to be irregularly shaped. The carriage is slideably mounted by any suitable means to the frame 12** for longitudinal axial slideable movement therealong.

From the foregoing, it will be seen that operation of the bucket is substantially similar to that described above. A tramming position of the bucket is indicated in phantom line at **30*a*', with the accompanying positions of the carriage 160, piston 170 and linkage members 162 and 166 also indicated at 160', 162', 166' and 170', respectively. A fully raised and fully extended loading or unloading position of the bucket 30*a* is indicated at 30*a*'', together with corresponding positions of the carriage 160'' linkages 162'', 164'' and of the piston 170''. A similar tailgate 28 is also provided with a suitable small hydraulic cylinder 122*a* for respectively opening and closing the tailgate 28. In all other respects, the structure and operation of the embodiment of FIG. 6 is substantially similar to that described above with reference to FIGS. 1 through 5**.

Figure 7:
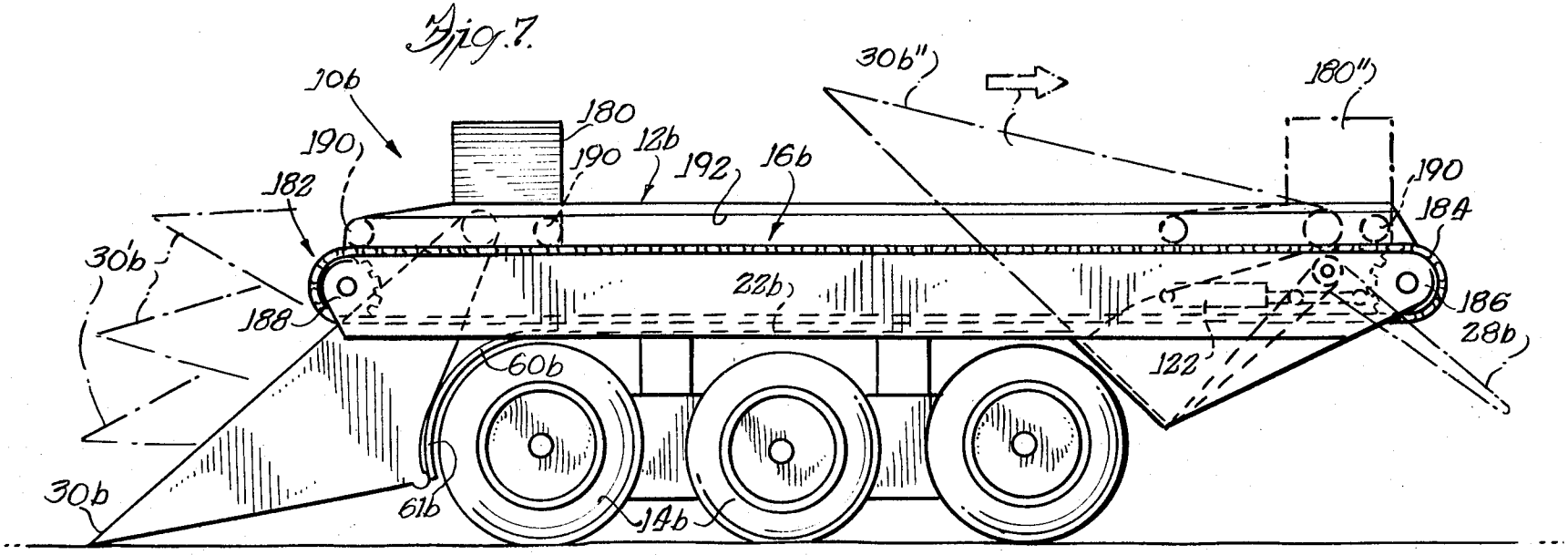
FIG. 7 is a side elevation illustrating yet another alternative form of apparatus in accordance with the invention.
Figure 8:
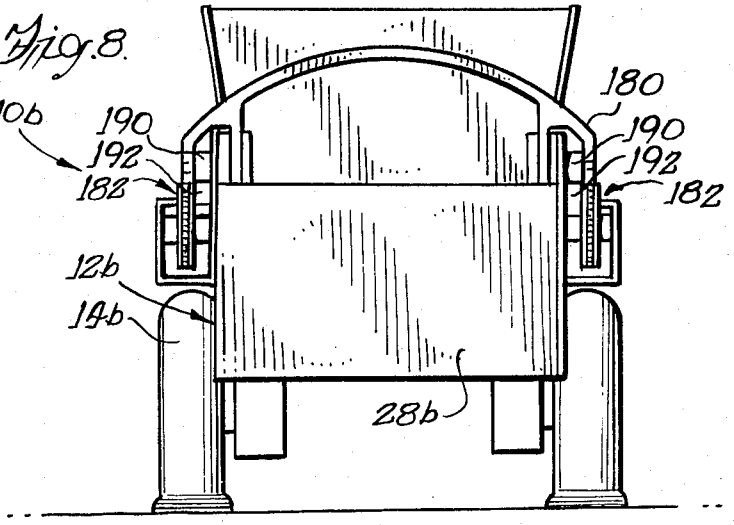
FIG. 8 is a rear elevation of the apparatus of FIG. 7.

Referring now to FIGS. 7 and 8 yet a further embodiment of apparatus in accordance with the invention is designated generally by the reference numeral **10*b*. The apparatus 10*b* includes a frame 12*b* mounted to suitable wheels 14*b* and carrying a load compartment 16*b* substantially as described above. A substantially similar bucket 30*b* is mounted for pivotal and sliding movement over a load deck or floor 22*b* and arcuate extensions 60*b*, 61*b* thereof in the same fashion described above. A similar tailgate 28 is actuated by a cylinder 122*b*** substantially as described above with reference to the previous embodiments.

A suitable carriage member 180 comprises a yoke similar to the yoke 44 described above. The carriage 180 is pivotally coupled at a similar pivotal mounting 54 to the upper end of an extension or arm of the bucket **30*b* in the same fashion as described above with respect to the previous embodiments. Departing from the previous embodiments, slideable axial movement of the carriage 180 is accomplished by a suitable chain drive or similar assembly, indicated generally by reference numeral 182 and comprising a suitable chain or endless member 184 and suitable drive and/or idler sprockets 186, 188. The carriage 180 may be coupled by any suitable means to a given point along the chain member 184 and may be provided with rollers or wheels 190 to ride upon a suitable track 192 or the like along the side of the frame 12*b*. As with the previous embodiment, a tramming position of the bucket is indicated generally in phantom line at 30*b*'. Similarly, a fully raised and fully rearwardly move position of the bucket with respect to the load compartment 16*b* is indicated at 30*b*'', with a corresponding position of the carriage 180 indicated at 180''. In all other respects, operation of the embodiment of FIGS. 7 and 8** is substantially similar to that described above for the previous embodiments.

While the invention has been illustrated and described above with reference to a preferred embodiment, it will be understood that various alternatives, changes and modifications may be made by those skilled in the art without departing from the invention. The invention includes all such alternatives, changes and modifications insofar as they fall within the spirit and scope of the appended claims.

The invention is claimed as follows:

1. Material handling apparatus comprising: a mobile frame defining a longitudinal axis, a raised load compartment on said mobile frame substantially in alignment with said longitudinal axis, and having open front and rear ends, a material handling bucket, a carriage mounted for bidirectional longitudinal movement along said frame in a substantially straight line axial direction defined by said longitudinal axis, pivot means movable in unison with the carriage and pivotally mounting said bucket to said carriage, actuating means for driving said carriage and said pivot means bidirectionally in said substantially straight line axial direction, said actuating means also being mounted for bidirectional movement in a substantially straight line in said axial direction, means defining a forward cam surface substantially continuous with said open front end of said raised load compartment and continuing to a location vertically therebelow, cooperating means on said bucket engageable with said cam surface for riding initially along said cam surface in response to initial straight line movement of said pivot means with said carriage away from the front end of said load compartment for initially both pivoting the bucket about said pivot means and lifting the bucket upwardly to and through the open front end of said load compartment to load material therein, and thereafter moving the bucket in said axial direction along said load compartment in response to continued further straight line movement of the carriage and pivot means away from the front end of the load compartment for alternatively filling the load compartment or clearing said load compartment of material previously loaded thereupon, through the open rear end thereof.

2. Apparatus according to claim 1 wherein said cooperating means on said bucket comprises means defining a cam surface on said bucket, said bucket cam surface being slideably movable with respect to said forward cam surface to achieve said pivoting and lifting movement in response to movement of said carriage.

3. Apparatus according to claim 2 wherein said bucket comprises means defining an open-ended material receiving volume terminating in a front lip and a rear heel, respectively, said bucket cam surface being located at said rear heel for pivoting said front lip in a generally vertical upward and downward direction in response to movement of said carriage in forward and rearward directions, respectively.

4. Apparatus according to claim 1 wherein at least a portion of said bucket is dimensioned complimentarily with a cross-section of said load compartment for drawing material axially thereacross.

5. Apparatus according to claim 1 and further including a movable tailgate for closing off said open rear end of said load compartment and tailgate actuator means for closing said tailgate during loading of said load compartment and for selectively opening said tailgate during unloading of said load compartment by said bucket.

6. Apparatus according to claim 3 wherein said forward cam surface comprises an arcuate surface defining an arc of at least 90 degrees between a horizontal plane at the level of the forward open end of said raised load receiving compartment and said location vertically therebelow.

7. Apparatus according to claim 1 wherein said actuating means comprises telescoping cylinder means mounted to said frame generally along an axis parallel with said longitudinal frame axis and coupled with said carriage.

8. Apparatus according to claim 7 wherein said telescoping cylinder means comprises a pair of substantially identical telescoping cylinder members, means defining a bearing surface on at least one portion of each said cylinder and means on respective lateral sides of said frame defining respective complimentary bearing surfaces for slideable longitudinal movement of each said cylinder member.

9. Apparatus according to claim 8 wherein said carriage further comprises generally U-shaped yoke means extending over and across said load compartment and having sidewall portions coupled to one part of each said telescoping cylinder members.

10. Apparatus according to claim 9 wherein said bearing surfaces defined on said frame comprise elongate recesses in side surfaces thereof and wherein said yoke means cooperates with the recesses for confining the cylinder members substantially to axial travel along the respective recesses.

11. Material handling apparatus comprising a frame having a raised load compartment for receiving material, said load compartment having a deck with a raised floor and opposed sides between opposite front and rear ends; a curved surface continuous with said raised floor and extending forwardly and downwardly therefrom; a bucket having opposed side walls, a heel, a lip, and a bucket bottom extending between said side walls and also between said lip and said heel; a carriage mounted for movement along the frame in a predetermined linear path between the ends of the load compartment, means pivotally mounting said bucket to said carriage along a pivot axis remote from said bottom and extending between said side walls, said bucket and said curved surface cooperating for providing a close sliding fit between a part of said bucket bottom at said heel and said curved surface during movement of the bucket to and from raised and lowered positions, in which lowered position said bottom and side walls project forwardly from the frame for loading the bucket and in which raised position said bucket heel is on said floor and said bucket bottom is inclined upwardly relative to said load compartment floor and with said heel slidable along said floor and said bucket side walls being closely spaced respectively to said opposed compartment sides, and means for moving said carriage and said pivot axis along said frame and through said predetermined linear path to raise and lower said bucket with initial linear movement of the carriage with the pivot axis toward the rear end of the compartment acting through the pivot means to effect the sliding fit movement between a part of the bucket at the heel and the floor curved surface such that it initially simultaneously lifts said bucket and rotates said bucket about said pivot axis toward the raised position and thereafter with further movement of the carriage and pivot axis toward the rear end of the compartment causes said bucket to move rearwardly linearly along the frame in the raised position for discharge of material into said compartment.

12. Material handling apparatus according to claim 11 in which said predetermined linear path is a path defined by said pivot axis and said load compartment floor and in which the bucket rotation about said pivot axis is effected by sliding engagement of said heel along said curved surface.

13. Material handling apparatus according to claim 12 in which said deck floor has an arcuate portion defining a portion of said curved surface, over which said heel slides during movement of the bucket from a lowered to a raised position and a generally flat additional portion over which the heel slides as the bucket in a raised position moves rearwardly along said compartment to discharge the material; said raised position being a selected position of elevation such that the bucket retains the load at an end of said compartment.

14. Apparatus according to claim 13 and further including a movable tailgate for closing off a rear end of said load compartment and tailgate actuator means for closing said tailgate during loading of said load compartment and for selectively opening said tailgate to permit unloading of said load compartment in response to slideable movement of said bucket heel across said load compartment floor.

15. Apparatus according to claim 11 wherein said carriage driving means comprises telescoping cylinder means mounted for telescoping movement along said predetermined linear path, which comprises a path generally along an axis parallel with a longitudinal frame axis and coupled with said carriage.

16. Apparatus according to claim 15 wherein said telescoping cylinder means comprises a pair of substantially identical telescoping cylinder members, means defining a bearing surface on at least one portion of each said cylinder and means on respective lateral sides of said frame defining respective complimentary bearing surfaces for slideable longitudinal movement of each said cylinder member.

17. Apparatus according to claim 16 wherein said carriage further comprises generally U-shaped yoke means extending over and across said load compartment and having sidewall portions coupled to one part of each of said telescoping cylinder members.

18. Apparatus according to claim 17 wherein said bearing surfaces defined on said frame comprise elongate recesses in side surfaces thereof and defining axes parallel to said longitudinal frame axis; and wherein said yoke means cooperates with the recesses for confining the cylinder member substantially to axial travel along the respective recesses.

19. Material handling apparatus comprising: a mobile frame defining a longitudinal axis, a raised load compartment on said mobile frame substantially in alignment with said longitudinal axis and having an open front end, a material handling bucket, a carriage mounted on said frame for longitudinal movement along the longitudinal axis of the frame, pivot means pivotally mounting said bucket to said carriage, actuating means for driving said carriage and said pivot means bidirectionally in a substantially straight line along said longitudinal axis, and cooperating means on said bucket and said frame for simultaneously pivoting and lifting the bucket to said load compartment in response to initial straight line longitudinal movement of said carriage and pivot means away from the front end of the load compartment for loading material through the open front end of said load compartment and for locking said open front end for tramming the loaded material.

20. Apparatus according to claim 1 wherein said actuating means comprises chain and sprocket drive means coupled to said frame for movement of a chain in said substantially straight line in an axial direction defined by the longitudinal axis, said chain being coupled with said carriage for thereby driving said carriage and said pivot means in said substantially straight line in said axial direction.

* * * * *